US009368878B2

(12) United States Patent
Chen et al.

(10) Patent No.: US 9,368,878 B2
(45) Date of Patent: Jun. 14, 2016

(54) RIDGE WAVEGUIDE SLOT ARRAY FOR BROADBAND APPLICATION

(71) Applicant: Victory Microwave Corporation, New Taipei (TW)

(72) Inventors: Ming H. Chen, Rancho Palos Verdes, CA (US); Chin-Yi Chu, Xizhi (TW); Di-Shang Hsu, Wujie Township (TW)

(73) Assignee: Pyras Technology Inc., Taoyuan (TW)

( * ) Notice: Subject to any disclaimer, the term of this patent is extended or adjusted under 35 U.S.C. 154(b) by 0 days.

(21) Appl. No.: 14/842,837

(22) Filed: Sep. 2, 2015

(65) Prior Publication Data

US 2016/0028165 A1 Jan. 28, 2016

Related U.S. Application Data

(63) Continuation-in-part of application No. 14/072,573, filed on Nov. 5, 2013, now Pat. No. 9,166,299, which is a continuation of application No. 12/471,367, filed on May 23, 2009, now Pat. No. 8,604,990.

(60) Provisional application No. 62/060,082, filed on Oct. 6, 2014.

(51) Int. Cl.

| | |
|---|---|
| ***H01Q 13/00*** | (2006.01) |
| ***H01Q 21/00*** | (2006.01) |
| ***H01Q 21/30*** | (2006.01) |

(52) U.S. Cl.

CPC ..... *H01Q 21/0062* (2013.01); *H01Q 21/0043* (2013.01); *H01Q 21/30* (2013.01)

(58) Field of Classification Search

USPC ..... 343/767–771, 702

See application file for complete search history.

(56) References Cited

U.S. PATENT DOCUMENTS

| | | | |
|---|---|---|---|
| 2,772,400 | A | 11/1956 | Simmons |
| 3,193,830 | A | 7/1965 | Provencher |
| 3,949,405 | A | 4/1976 | Roquencourt |
| 4,638,323 | A | 1/1987 | Shnitkin et al. |
| 5,579,015 | A | 11/1996 | Collignon |

(Continued)

FOREIGN PATENT DOCUMENTS

| | | |
|---|---|---|
| CN | 101562280 | 10/2009 |

OTHER PUBLICATIONS

English language abstract for CN 101562280.

*Primary Examiner* — Huedung Mancuso

(74) *Attorney, Agent, or Firm* — Clifford Perry

(57) ABSTRACT

A ridged waveguide slot array includes a waveguide slot body having one or more walls that define a longitudinal axis of the waveguide slot body. The waveguide slot body includes a narrowed waveguide section having a plurality of slots disposed thereon which extend along the longitudinal axis, the waveguide slot body further characterized by a longitudinal center line. The waveguide slot body defines a waveguide aperture having a major dimension and a minor dimension, wherein the major dimension of the waveguide aperture is less than one-half wavelength of a signal intended for propagation therein. Each slot of the plurality of slots is characterized by a slot area, a slot offset distance that extends from the center of the slot to the longitudinal center line, and a slot-to-slot separation distance extending from the center of the slot to the center of an adjacent slot. Each of the slot area, the slot offset distance and the slot-to-slot separation distance is decreased successively for a succession of the plurality of slots.

15 Claims, 12 Drawing Sheets

(56) References Cited

U.S. PATENT DOCUMENTS

| | | | | | |
|---|---|---|---|---|---|
| 5,638,079 | A | | 6/1997 | Kastner et al. | |
| 5,914,694 | A | | 6/1999 | Rabb | |
| 5,990,844 | A | * | 11/1999 | Dumont | H01Q 21/0043 29/600 |
| 6,115,002 | A | * | 9/2000 | Fischer | H01Q 21/0087 343/770 |
| 6,127,985 | A | | 10/2000 | Guler | |
| 6,509,881 | B2 | | 1/2003 | Falk | |
| 7,307,596 | B1 | | 12/2007 | West | |
| 7,327,325 | B2 | | 2/2008 | Schadler | |
| 7,554,504 | B2 | | 6/2009 | Mohamadi | |
| 8,604,990 | B1 | | 12/2013 | Chen et al. | |
| 8,610,633 | B2 | | 12/2013 | Chen et al. | |
| 2005/0219136 | A1 | | 10/2005 | Iskander et al. | |
| 2006/0114165 | A1 | | 6/2006 | Honda et al. | |
| 2006/0132374 | A1 | | 6/2006 | Wang | |
| 2009/0022445 | A1 | | 1/2009 | Hochberg et al. | |
| 2010/0187442 | A1 | | 7/2010 | Hochberg et al. | |
| 2012/0033294 | A1 | | 2/2012 | Beausoleil et al. | |
| 2014/0055311 | A1 | | 2/2014 | Chen et al. | |

* cited by examiner

| Li | (mm) | Wi | (mm) | Di | (mm) | Si | (mm) | Half-wavelength frequency(GHz) |
|---|---|---|---|---|---|---|---|---|
| L0 | 215.00 | W0 | 32.25 | D0 | 216.19 | S0 | 45.00 | 0.70 |
| L1 | 231.13 | W1 | 34.67 | D1 | 235.97 | S1 | 45.90 | 0.65 |
| L2 | 248.46 | W2 | 37.27 | D2 | 258.68 | S2 | 46.82 | 0.60 |
| L3 | 267.09 | W3 | 40.06 | D3 | 285.16 | S3 | 47.75 | 0.56 |
| L4 | 287.13 | W4 | 43.07 | D4 | 316.66 | S4 | 48.71 | 0.52 |
| L5 | 308.66 | W5 | 46.30 | D5 | 355.12 | S5 | 49.68 | 0.49 |
| L6 | 331.81 | W6 | 49.77 | D6 | 403.82 | S6 | 50.68 | 0.45 |
| L7 | 356.70 | W7 | 53.50 | | | S7 | 51.69 | 0.42 |

Elevation Pattern( $\varphi=90^{\circ}$ )

Azimuth Pattern with Downtilt 5°

RIDGE WAVEGUIDE SLOT ARRAY FOR BROADBAND APPLICATION

CROSS-REFERENCE TO RELATED APPLICATIONS

The present application is a continuation-in-part of U.S. Ser. No. 14/072,573 filed Nov. 5, 2013, which is a continuation of U.S. Ser. No. 12/471,367 filed May 23, 2009, the contents of each of which are incorporated herein in its entirety for all purposes.

The present application further claims the benefit of priority to U.S. 62/060,082 filed Oct. 6, 2014, entitled "Ridge Waveguide Slot Array for Broadband Application," the contents of which are incorporated herein in its entirety for all purposes.

BACKGROUND

The present invention relates to waveguide antenna, and particularly to ridged waveguide slot array antennae.

Waveguide slot array antennae are well known in the art, and are typically employed for providing high power capability in applications, such as base station transmitting antenna arrays.

FIG. 1A illustrates a conventional vertically-polarized waveguide slot array 100 as known in the art. The array 100 includes a waveguide slot body 110 which is operable to support the propagation of a signal along a longitudinal axis 112 (z-axis) of the waveguide slot body 110. Transverse to the longitudinal axis 112, the waveguide slot body 110 defines a waveguide aperture having a major dimension 113 (along the x-axis) and a minor dimension 114 (along the y-axis). The major dimension 113 defines the lowest frequency of operation for the array 100, and is typically 0.5λ in its dimension. The waveguide slot body 110 further includes edge slots 122 and 124, each angled α in respective positive and negative angular orientations relative to the axis of the minor dimension 114. An end cap 130 is located at the top of the array 100.

FIG. 1B illustrates typical radiation patterns 150 for the vertically-polarized waveguide slot array 100 of FIG. 1A. The patterns 150 include an azimuth radiation pattern 152 and an elevation pattern 154. The azimuth radiation pattern 152 exhibits 8 dB variation, as shown.

FIG. 2A illustrates a conventional horizontally-polarized waveguide slot array 200 with horizontal polarization as known in the art. The array 200 includes a waveguide slot body 210 which is operable to support the propagation of a signal along a longitudinal axis 212 (z-axis) of the waveguide slot body 210. Transverse to the longitudinal axis 212, the waveguide slot body 210 defines a waveguide aperture having a major dimension 213 (along the x-axis) and a minor dimension 214 (along the y-axis). The major dimension 213 defines the lowest frequency of operation for the array 200, and is typically 0.5λ in its dimension. The waveguide slot body 210 further includes longitudinal slots 220, each slot offset a predefined distance from a center line defining the major axis 212 of the waveguide body 210, adjacent slots offset in opposing directions from the center line. An end cap 230 is located at the top of the array 200.

FIG. 2B illustrates typical radiation patterns 250 for the horizontally-polarized waveguide slot array 200 of FIG. 2A. The patterns 250 include an azimuth radiation pattern 252 and an elevation pattern 254. The azimuth radiation pattern 252 exhibits 4 dB variation, as shown.

As can be observed, the azimuth radiation patterns for each of the conventional vertically and horizontally-polarized waveguide slot arrays vary significantly over the coverage area, meaning that signal levels over these coverage areas vary greatly as a function of the user's position. As a result, a high power transmitter or a high gain antenna is needed to ensure that the minimum signal level is provided to all users, independent of their location. Accordingly, although slot arrays are suitable for high power transmission and reception applications, they cannot be fully deployed in applications where uniform coverage is needed.

U.S. Pat. No. 8,604,990 described a Ridged Waveguide Slot Array operable to provide more uniform coverage. However, a slot array operable with such characteristics over a broader operating frequency would be even more advantageous.

SUMMARY

In accordance with one embodiment of the present invention, a ridged waveguide slot array which operates to provide a broader band radiation pattern compared to conventional waveguide slot arrays is now presented. An exemplary embodiment of the ridged waveguide slot array includes a waveguide slot body having one or more walls that define a longitudinal axis of the waveguide slot body. The waveguide slot body includes a narrowed waveguide section having a plurality of slots disposed thereon which extend along the longitudinal axis, the waveguide slot body further characterized by a longitudinal center line. The waveguide slot body defines a waveguide aperture having a major dimension and a minor dimension, wherein the major dimension of the waveguide aperture is less than one-half wavelength of a signal intended for propagation therein. Each slot of the plurality of slots is characterized by a slot area, a slot offset distance that extends from the center of the slot to the longitudinal center line, and a slot-to-slot separation distance extending from the center of the slot to the center of an adjacent slot. Each of the slot area, the slot offset and the slot-to-slot separation distance is decreased successively for a succession of the plurality of slots.

In one embodiment, the slot area includes a slot width and a slot length. Further with respect to this embodiment, each of the slot length, the slot width, the slot offset distance and the slot-to-slot separation distance is decreased successively for a succession of the plurality of slots.

In another embodiment, adjacent slots are offset in opposing directions from the longitudinal center line.

In a further embodiment, the ridged waveguide slot array includes a first end of the ridged waveguide slot array, and a second end coupled to receive a transmission signal. In this embodiment, a slot having each of the smallest slot area, the slot offset and the slot-to-slot separation distance is located proximate to the second end, and a slot having the largest slot area, the slot offset distance and the slot-to-slot separation distance is located proximate to the first end.

These and other features of the invention will be better understood in light of the following detailed description and drawings.

For clarity, previously identified features retain their reference indicia in subsequent drawings.

DETAILED DESCRIPTION OF EXEMPLARY EMBODIMENTS

In accordance with the present invention, a ridged waveguide slot array is presented which provides improved performance. The new slot array includes a waveguide slot body having one or more walls which define a longitudinal axis of the waveguide slot body, and a plurality of waveguide slots disposed on the one or more walls of the waveguide slot body. The new slot array further includes a ridged waveguide section which is attached (directly or indirectly via an intervening structure) to the waveguide slot body, the ridged waveguide section including two spaced-apart opposing ridges that attach (directly or indirectly) to the one or more walls of the waveguide slot body, and that extend along the longitudinal axis of the waveguide slot body. The attaching of a ridged waveguide section to the waveguide slot body allows for advantages, such as a more uniform radiation pattern and smaller cross-sectional dimensions of the structure compared to conventional waveguide slot arrays.

In a particular embodiment, the waveguide slot body implemented in the present invention defines a waveguide aperture having a major dimension and a minor dimension, whereby the major dimension of the waveguide aperture is smaller than 0.5λ (the minor dimension is smaller than the major dimension in order for the major dimension to define the lowest operating mode of the waveguide array). In one embodiment, the major dimension is less than 0.4λ, and in still another embodiment, the major dimension is less than 0.35λ. The reduction in size across the major axis of the waveguide slot body (i.e., the "A" dimension of the waveguide aperture) permits closer slot spacing, thus providing a more uniform azimuth antenna pattern.

In one embodiment, a vertically-polarized ridged waveguide slot array is disclosed in which the ridged waveguide section is disposed substantially along the longitudinal center of the waveguide slot body. In another embodiment, a horizontally-polarized ridged waveguide slot array is disclosed in which the ridged waveguide section is realized as two ridged waveguide sections which extend longitudinally along opposing lateral sides of the waveguide slot body.

The following embodiments illustrate dimensions of the ridged waveguide slot array for a desired frequency of operation of 542-580 MHz, although the invention may be employed at any frequency, for example, any RF or Microwave frequency, such as one or more frequencies over the range of 100 MHz to 40 GHz.

Figure 1A:
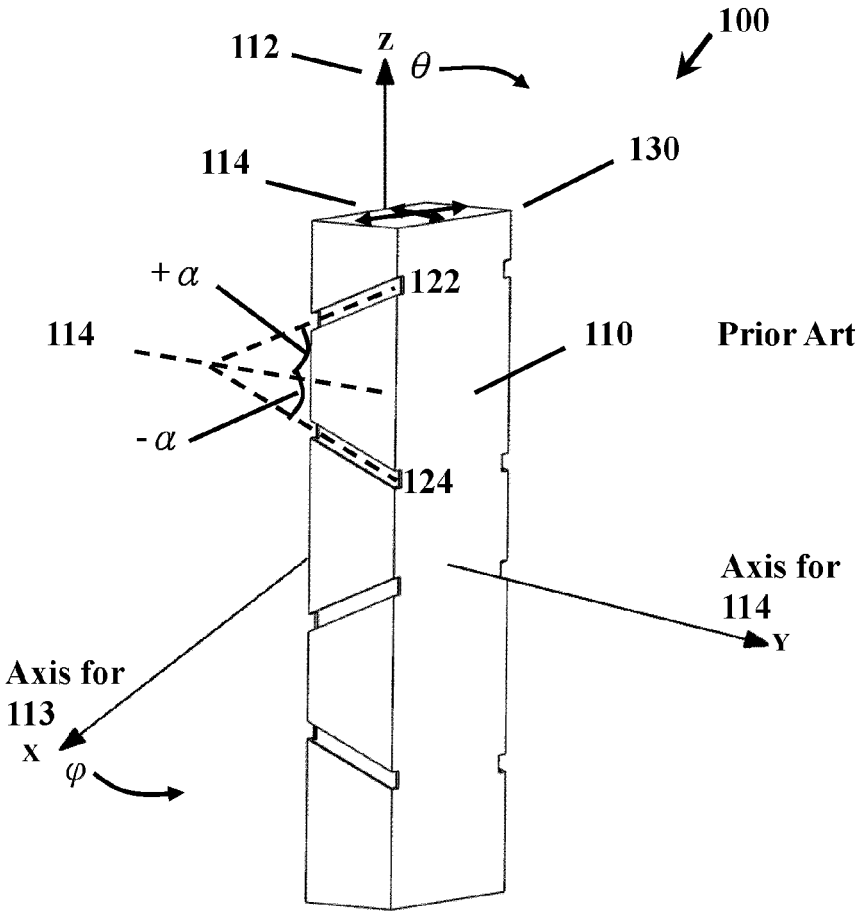
FIG. 1A illustrates a conventional vertically-polarized waveguide slot array as known in the art.
Figure 1B:
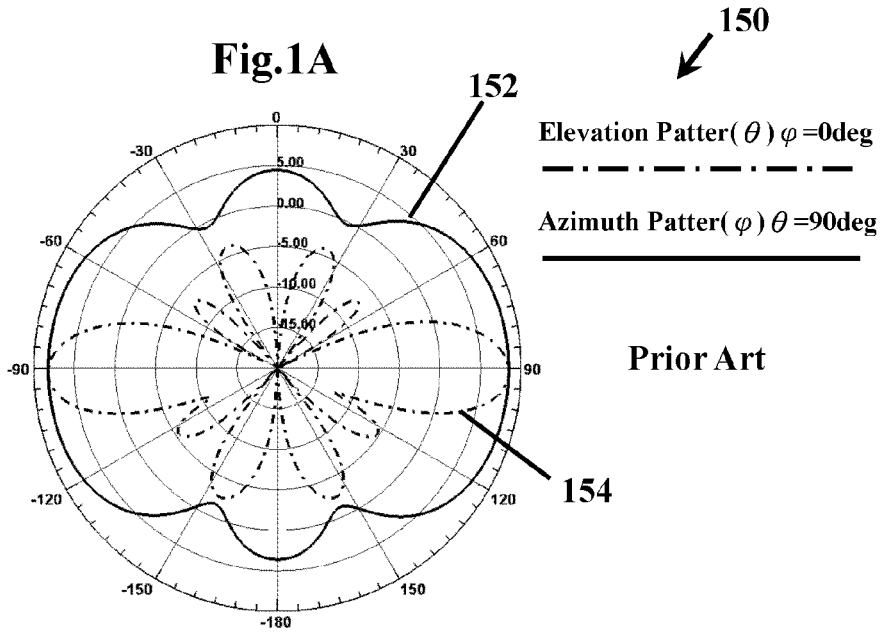
FIG. 1B illustrates a typical elevation and azimuth radiation pattern for the vertically-polarized waveguide slot array of FIG. 1A.
Figure 2A:
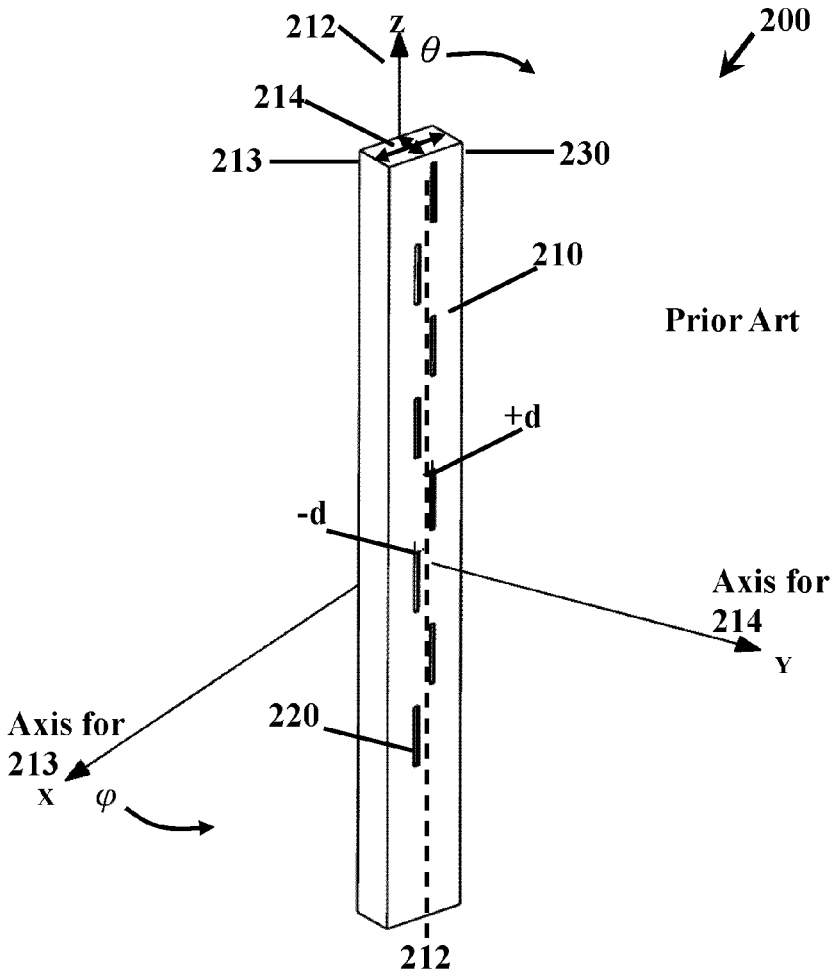
FIG. 2A illustrates a conventional horizontally-polarized waveguide slot array as known in the art.
Figure 2B:
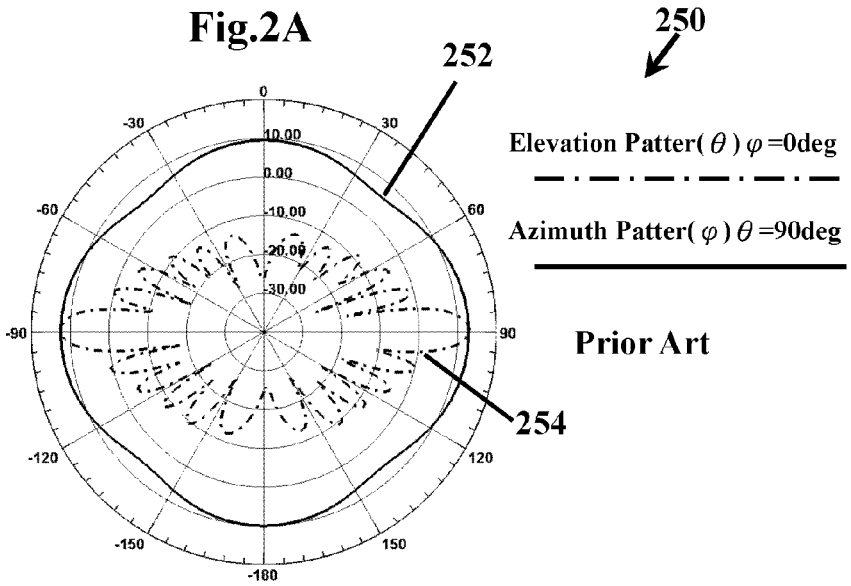
FIG. 2B illustrates a typical elevation and azimuth radiation pattern for the horizontally-polarized waveguide slot array of FIG. 2A.
Figure 3A:
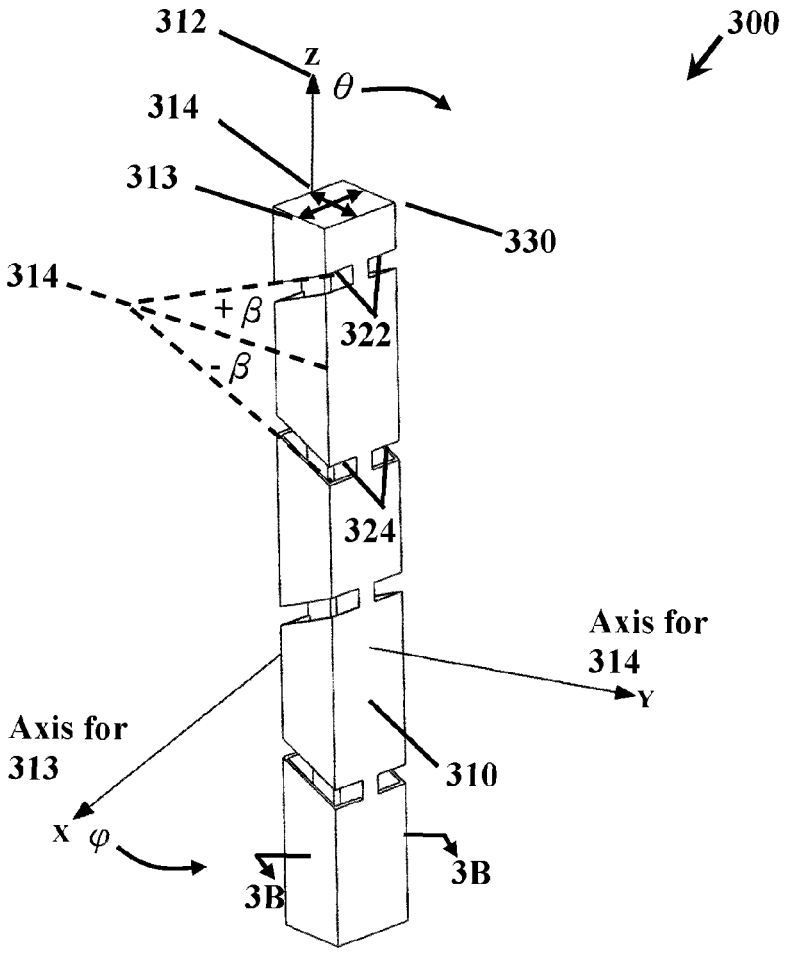
FIG. 3A illustrates a perspective view of a vertically-polarized ridged waveguide slot array in accordance with one embodiment of the present invention.

FIG. 3A illustrates a perspective view of a vertically-polarized ridged waveguide slot array provided in accordance with one embodiment of the present invention. The array 300 includes a waveguide slot body 310 having edge slots 322 and 324 disposed thereon. The waveguide slot body 310 is oriented along a longitudinal axis (exemplary shown as the z-axis) 312 which is the direction of propagation of a signal injected therein.

Transverse to the longitudinal axis 312, the waveguide slot body 310 defines a waveguide aperture (further detailed below) having a major dimension 313 (shown along the x-axis) and a minor dimension 314 (shown along the y-axis). The major dimension 313 defines the lowest frequency of operation for the array 300, and in one embodiment, is less than 0.5λ in its dimension. The waveguide slot body 310 further includes edge slots 322 and 324, each angled β in respective positive and negative angular orientations relative to the axis of the minor dimension 314. Further exemplary, each of the edge slots 322 and 324 extend around multiple sides of the waveguide body 310, and in a particular, extend around the entire periphery of the waveguide body 310. In the illustrated embodiment in which the waveguide body 310 is a rectangular waveguide, the edge slots 322 and 324 extend to all four walls of the waveguide body 310. Further particularly, the edge slots 322 and 324 are angled relative to the axis of the minor dimension 314 along two walls of the waveguide body 310, and are not angled (relative to the major dimension 313) along the two other walls of the waveguide body. An end cap 330 is located at the top of the array 300.

Figure 3B:
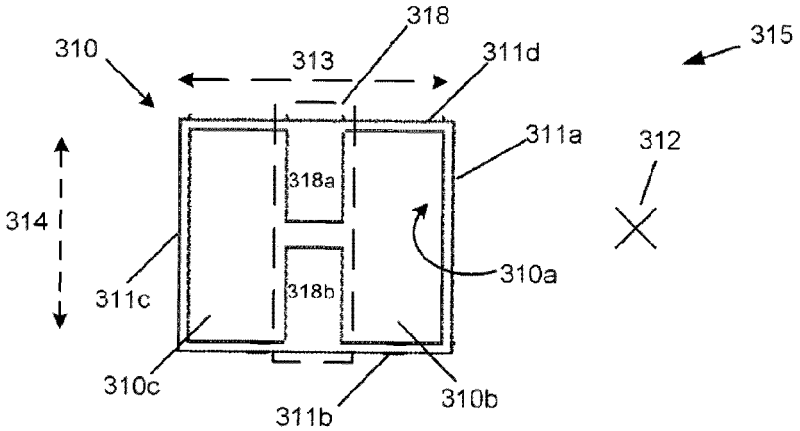
FIG. 3B illustrates an exemplary waveguide aperture for the vertically-polarized ridged waveguide slot array shown in FIG. 3A.

FIG. 3B illustrates an exemplary waveguide aperture 315 for the vertically-polarized ridged waveguide slot array 300 shown in FIG. 3A. The edge slots 322 and 324 are not shown so as to avoid obscuring the figure. The waveguide aperture 315 has a major dimension 313 and a minor dimension 314. Along the axis of the minor dimension 314 and on the internal surface 310*a* of the waveguide body 310, a ridged waveguide section 318 is attached to the waveguide slot body 310. The ridged waveguide section is composed of two opposing ridges 318*a* and 318*b* that extend along the longitudinal center line (extending into/out of the plane of the drawing) of the slot waveguide body 310, as shown. Collectively, the opposing ridges 318*a* and 318*b* create two waveguide sub-sections 310*b* and 310*c* which emulate the operation of a waveguide section of a larger cross-sectional dimension. In an exemplary embodiment, dimension 313 is 0.34λ and dimension 314 is 0.28λ, with ridges 318*a* and 318*b* having a width (horizontal dimension) as 0.073λ and spaced apart by a gap of 0.035λ. Exemplary, the cross-sectional dimension of sub-sections 310*b* and 310*c* is 0.31λ×0.134λ. In a particular embodiment, the two spaced-apart ridges 318*a* and 318*b* provides capacitive coupling along the longitudinal center line of the waveguide slot body 310. While the ridged waveguide section 318 is illustrated as two spaced-apart opposing ridges, those skilled in the art will appreciate that the same electrical effect can be obtained using other means, for example a single ridge which extends from the upper or lower wall to close proximity to the opposing wall to provide the desired (e.g., capacitive) coupling effect therebetween. Further, the same electrical effect can be obtained using discrete components, such as capacitive elements disposed along the longitudinal center line of the waveguide slot body 310.

The exemplary waveguide slot body 310 includes two side walls 311*a* and 311*c* and two broadside walls 311*b* and 311*d*. Further particularly, the edge slots 322 and 324 are angled relative to the axis of the minor dimension 314 along the two side walls 311*a* and 311*c* of the waveguide slot body 310, and are not angled (relative to the major dimension 313) along the two broadside walls 311*b* and 311*d* of the waveguide slot body 310.

Figure 3C:
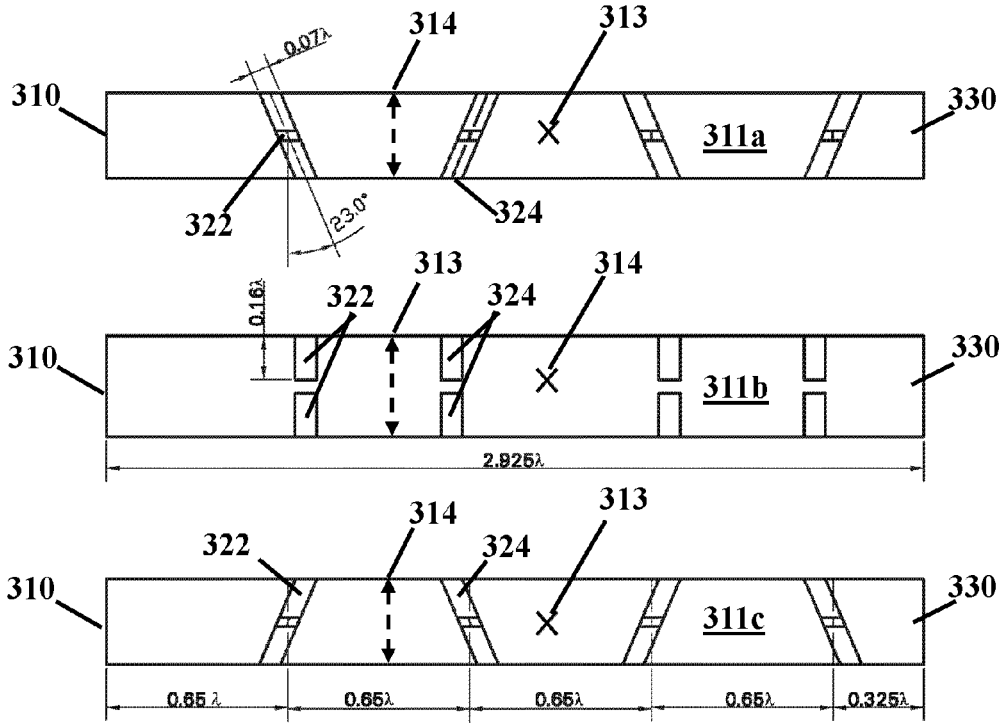
FIG. 3C illustrates views of broadside and side surfaces of the vertically-polarized ridged waveguide slot array shown in FIG. 3A.

FIG. 3C illustrates views of side walls 311*a*, 311*c* and broadside walls 311*d*. Edge slots 322, 324 are disposed on at least one of the side walls 311*a*, 311*c*. In particular, first edge slot 322 is disposed at a predefined angle beta β in a positive angular orientation relative to the axis of the minor dimension 314. Complementary, a second edge slot 324 is located adjacent to the first edge slot 322 and is disposed at said predefined angle β in a negative angular orientation relative to the axis of the minor dimension 314. The predefined angle β may range from a number of values, for example, 0 degrees to 90 degrees or more particularly 0 degrees to 45 degrees. In one embodiment, β is 23 degrees. In an exemplary embodiment, the edge slots 322 and 324 are complementary-angled 23 degrees relative to the axis of the body's minor dimension 314, so as to provide in-phase contributions. The exemplary slots have a width 0.07λ and are spaced 0.65λ apart, and the end cap/short 330 is spaced 0.325λ away from the center of the most proximate slot. Four slots are shown with the antenna 300 having a total length of 2.925λ, although a different number of slots may be implemented in accordance with the invention.

Further exemplary of the ridged waveguide slot array with vertical polarization, each edge slot extends to each of (i.e., at least reaches) the two side walls 311*a*, 311*c* and to each of the broadside walls 311*b*, 311*d*. That is, the edge slots 322 and 324 extend to all four sides of the body 310, as the length of each edge slot 322 and 324 approaches 0.5λ, and because the cross-section of the body 310 is reduced.

Figure 3D:
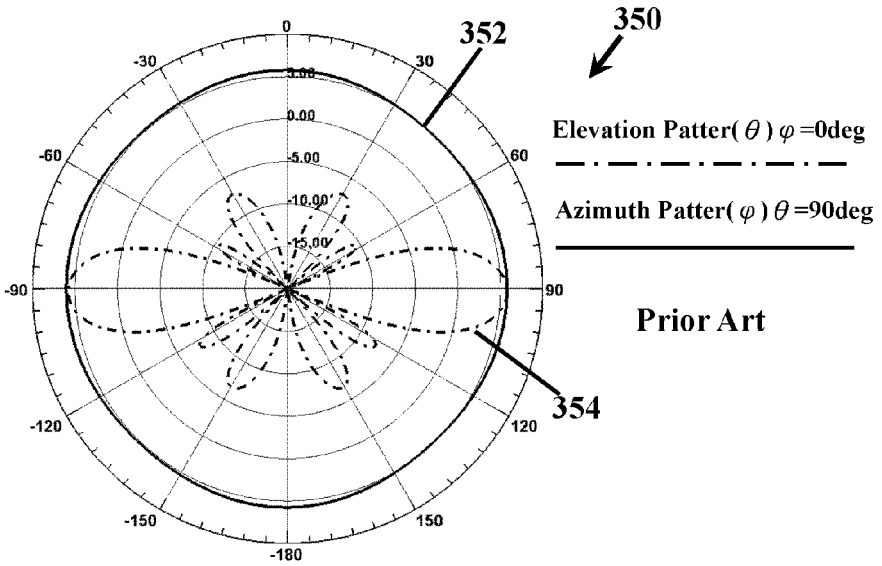
FIG. 3D illustrates elevation and azimuth radiation patterns for the vertically-polarized ridged waveguide slot array shown in FIG. 3A.

FIG. 3D illustrates elevation and azimuth radiation patterns for the vertically-polarized ridged waveguide slot array of FIGS. 3A-3C. As can be seen, the ridged waveguide slot array 300 has a more uniform azimuth radiation pattern 352, exhibiting less than 1 dB compared to 8 dB to the azimuth radiation pattern 152 of the conventional slot array. In exemplary embodiments, the vertically-polarized ridged waveguide slot array 300 is implemented in 1.8 GHz GSM systems, 2.2 GHz WiFi Systems, or 3.5 GHz WiMax systems.

Figure 4A:
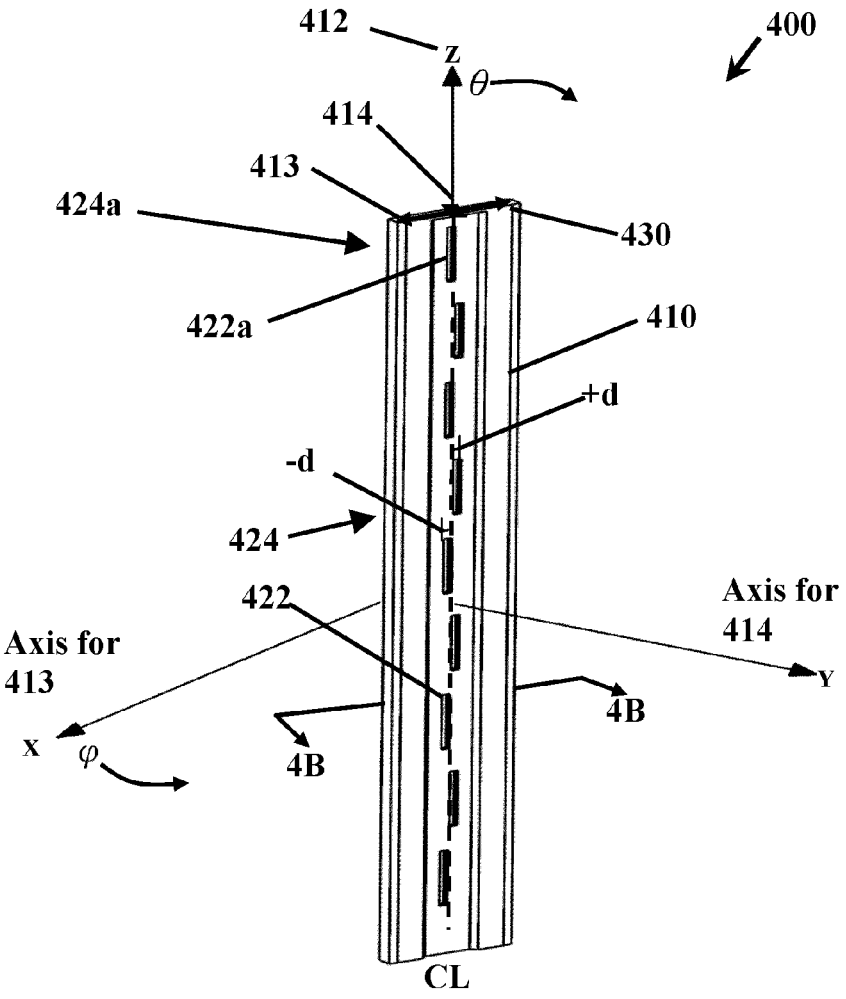
FIG. 4A illustrates a perspective view of a horizontally-polarized ridged waveguide slot array in accordance with one embodiment of the present invention.

FIG. 4A illustrates a perspective view of one embodiment of a horizontally-polarized ridged waveguide slot array 400 in accordance with one embodiment of the present invention. The array 400 includes a waveguide slot body 410 having longitudinal slots 422 and 424 disposed thereon. The waveguide slot body 410 is oriented along a longitudinal axis (exemplary shown as the z-axis) 412 which is the direction of propagation of a signal injected therein.

Transverse to the longitudinal axis 412, the waveguide slot body 410 defines a waveguide aperture (further detailed below) having a major dimension 413 (shown along the x-axis) and a minor dimension 414 (shown along the y-axis). The major dimension 413 defines the lowest frequency of operation for the array 400, and in one embodiment, is less than 0.5λ in its dimension. The waveguide slot body 410 includes longitudinal slots 422 and 424 disposed on respective opposing broadsides of the waveguide body 410. Each slot 422 is offset a predefined distance "d" from a center line "CL" of the waveguide slot body 410, whereby adjacent slots on this broadside wall are offset in opposing directions from the center line CL. Longitudinal slots 424 are disposed on the opposing broadside wall of the waveguide slot body 410 and represent a continuation of longitudinal slots 422 bored through the hollow waveguide slot body 410 into the second/opposing broadside wall. As such, opposing longitudinal slots 424 are disposed at substantially the same coordinates along the second/opposing broadside wall as slots 422 are disposed along the first broadside wall. An end cap 430 is located at the top of the array 400. The first longitudinal slots (top most, and starting most proximate to end cap 430) on each broadside of the waveguide slot body 410 are identified with reference indicia 422*a* and 424*b*.

Figure 4B:
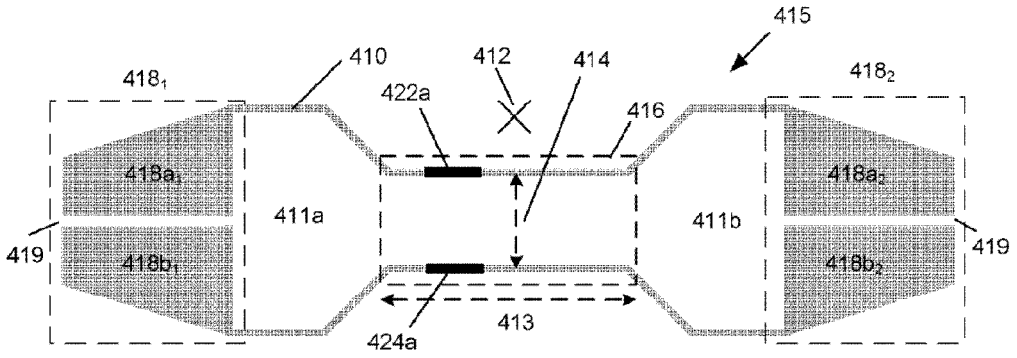
FIG. 4B illustrates an exemplary waveguide aperture for the horizontally-polarized ridged waveguide slot array shown in FIG. 4A.

FIG. 4B illustrates an exemplary waveguide aperture 415 for the horizontally-polarized ridged waveguide slot array 400 shown in FIG. 4A. The longitudinal slots 422 and 424 (only opposing slots 422*a* and 424*a* are shown to avoid obscuring the drawing) are disposed on opposing broadside walls of the waveguide body 410. The waveguide aperture 415 includes the waveguide slot body 410 and two ridged waveguide sections $\mathbf{418}_1$ and $\mathbf{418}_2$ attached to the opposing sides of the waveguide body 410. The waveguide slot body 410 includes two tapered waveguide sections 411*a* and 411*b* which are laterally opposed along the major dimension axis 413 of the waveguide aperture 415, and a narrowed waveguide section 416 which is disposed between the two tapered waveguide sections 411*a* and 411*b*. As shown, the major dimension 413 is the major dimension of the narrowed waveguide section 416, and this dimension, in one embodiment of the invention, is less than 0.5λ. In an exemplary embodiment, the cross-sectional dimension of the narrowed waveguide section 416 is 0.20λ (w)×0.009λ (h). Exemplary, each tapered waveguide section 411*a* and 411*b* measures 0.085λ (w)×0.09λ (h), tapering down to a height of 0.009λ (h), as shown.

As shown, longitudinal slots 422 and 424 (only slots 422*a* and 424*a* are depicted to avoid obscuring the drawing) are disposed (e.g., cut) in the narrowed waveguide section 416 on respective broadsides thereof. In the illustrated embodiment, a plurality of longitudinal slots 422 are provided such that each is offset a predefined distance d from a center line CL along the longitudinal axis 412 of the ridged waveguide body 410, adjacent longitudinal slots being offset in opposing directions from the center line. The offsetting distance can be selected based upon the desired operating frequency. Opposing longitudinal slots 424 are disposed on the opposing broadside wall within the narrowed waveguide section 416 of the waveguide body 410 at substantially the same coordinates opposite the longitudinal slots 422. In an exemplary embodiment, dimension "d" is 0.045λ, and the center to center slot spacing is 0.56λ, with each slot measuring 0.43λ in the longitudinal directional and 0.046λ in the direction normal thereto.

As known in the art, the radiation characteristics on the horizontal plane (azimuth pattern) of the ridged waveguide slot array 400 is determined largely by the relative distance between the opposing broadside slots 422 and 424 on the horizontal plane, and the shape of outer contour of the ridged waveguide slot array 400 separating these two sets of slots. Each slot (e.g., 422*a*) will typically have the same phase angle relative to its corresponding slot (e.g., 424*a*), (e.g., the phase angle being, e.g., 0 degrees relative to the longitudinal axis of the waveguide slot body), each slot operable as a resonator to excite a current on the waveguide outer wall to contribute to the total radiation pattern. In order to create a uniform signal distribution around the 360° area of the array, the distance between corresponding (opposing broadside) slots (e.g., 422*a* and 424*a*) should be relatively short (e.g., less than 0.01λ) as it would prove difficult to compensate for the phase differences between the two corresponding slots if the slots were separated by a significant distance.

The array 400 includes two laterally-opposed ridged waveguide sections $\mathbf{418}_1$ and $\mathbf{418}_2$. Each of the ridged waveguide sections $\mathbf{418}_1$ and $\mathbf{418}_2$ includes two spaced apart opposing ridges 418*a* and 418*b* which extend longitudinally along opposing lateral sides of the waveguide slot body 410. Further exemplary, the exterior surfaces of each ridged waved section $\mathbf{418}_1$ and $\mathbf{418}_2$ may be tapered to further provide a more uniform electrical path between the opposing broadside slots (e.g., 422*a* and 424*a*) on the waveguide slot body 410. The external surfaces of sections $\mathbf{418}_1$ and $\mathbf{418}_2$ may be formed in the shape other contours, e.g., elliptical, circular, or exponential tapers or any other shape. Exemplary, each ridged waveguide section $\mathbf{418}_1$ and $\mathbf{418}_2$ measures 0.13λ (w)× 0.004λ (h), tapering down to a height of 0.0036λ (h), as shown. Gap 419 providing separation between the opposed ridges $\mathbf{418}a_1$ and $\mathbf{418}b_1$ and opposed ridges $\mathbf{418}a_2$ and $\mathbf{418}b_2$ measures 0.001λ (h). In another embodiment, the gap 419 is removed and the two opposing ridges 418*a* and 418*b* are brought into contact with each other, or alternatively form a single piece. In such an embodiment, the exterior surfaces of each waveguide section $\mathbf{418}_1$ and $\mathbf{418}_2$ are described as above, i.e., each may be tapered or otherwise shaped (elliptical, circular, exponential tapers) to provide a more uniform electrical path between opposing broadside slots (e.g., 422*a* and 424*a*) on the waveguide slot body 410.

Use of the ridged waveguide sections $\mathbf{418}_1$ and $\mathbf{418}_2$ provides more freedom to adjust the horizontal radiation pattern of the array 400, as the outer contour of the ridged waveguide sections $\mathbf{418}_1$ and $\mathbf{418}_2$ can be modified/shaped to adjust the electrical length between opposing broadside slots 422*a* and 424*a*, thus providing a means to optimize the horizontal radiation pattern. In the illustrated embodiment, the ridged waveguide sections provide capacitive coupling along lateral sides of the waveguide slot body 410 down the longitudinal axis 412. While each ridged waveguide section 418 is illustrated as two spaced-apart opposing ridges 418*a* and 418*b*, those skilled in the art will appreciate that the same electrical effect can be obtained using other means, for example a single ridge which extends from the upper or lower wall to close proximity to the opposing wall to provide the desired (e.g., capacitive) coupling effect therebetween. Further, the same electrical effect can be obtained using discrete components, such as capacitive elements disposed along the lateral sides of the waveguide slot body 410.

Figure 4C:
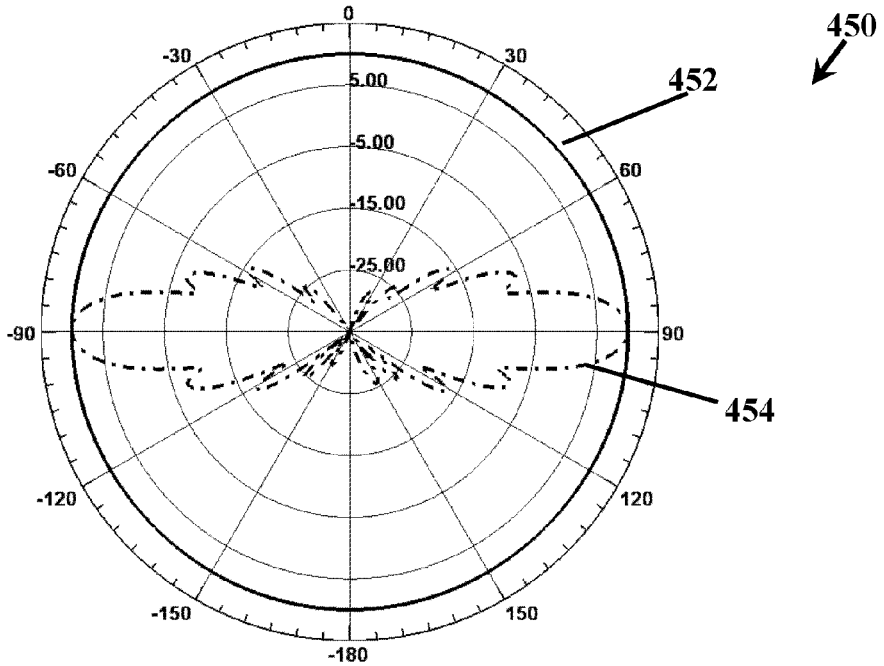
FIG. 4C illustrates the elevation and azimuth radiation pattern for the ridged waveguide slot array of FIG. 4A.

FIG. 4C illustrates the elevation and azimuth radiation pattern for the horizontally-polarized ridged waveguide slot array 400 of FIGS. 4A and 4B at a frequency of 0.545 GHz where the azimuth radiation pattern 452 is shown at θ=90° and the elevation radiation pattern 454 is shown at ϕ=90°. As can be seen, the ridged slot array 400 has a more uniform azimuth radiation pattern 452, exhibiting less than 1 dB compared to 4 dB to the azimuth radiation pattern 252 of the conventional slot array.

Figure 4D:
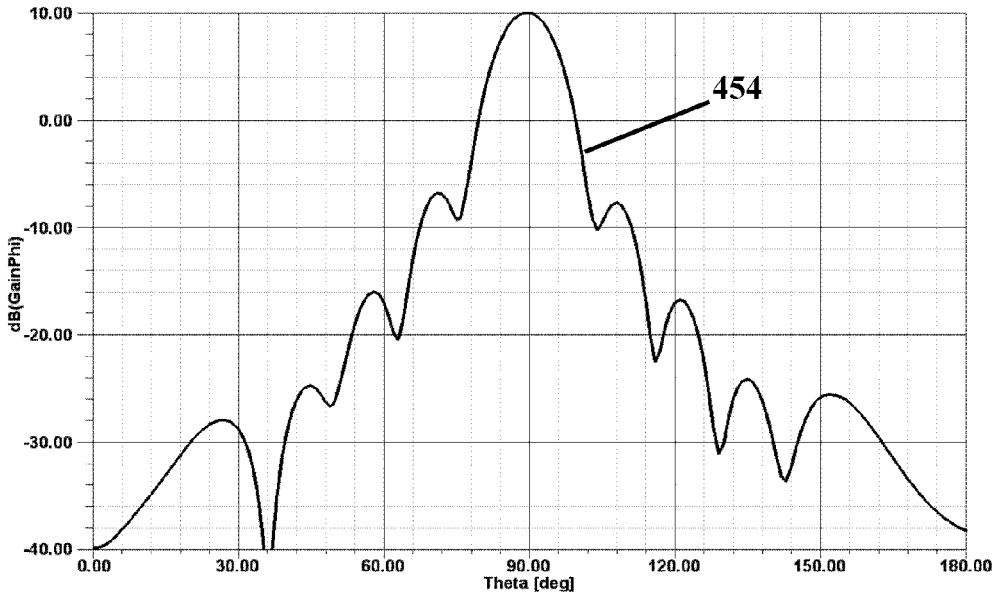
FIG. 4D illustrates the elevation radiation pattern for the ridged waveguide slot array of FIG. 4A at $\phi=90°$ over angle $\theta$ between 0° and 180°.
Figure 4E:
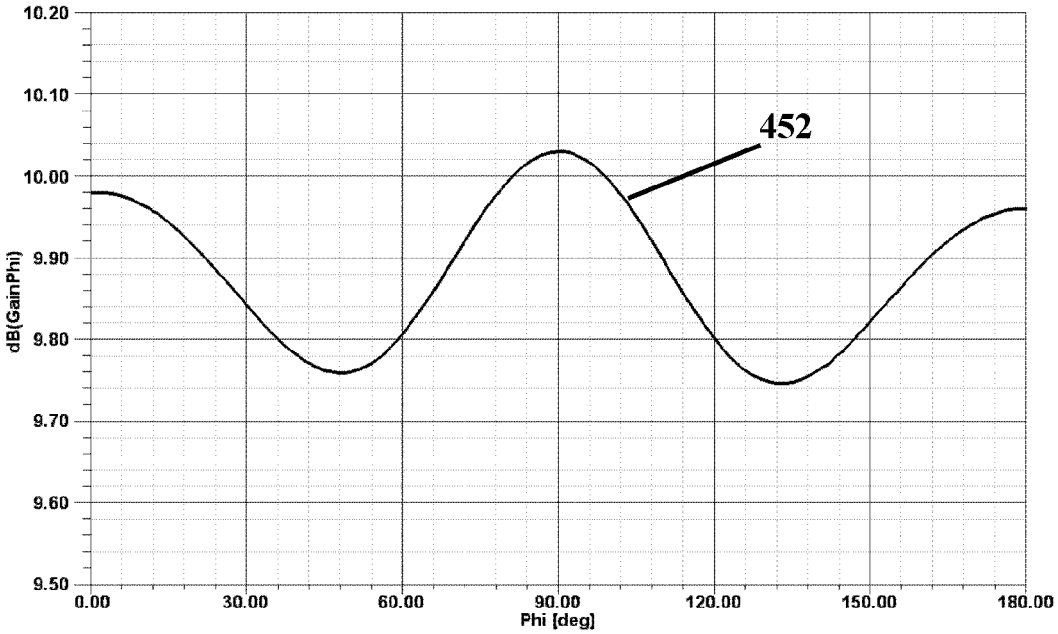
FIG. 4E illustrates the azimuth radiation pattern for the ridged waveguide slot array of FIG. 4A at $\theta=90°$ over angle $\phi$ between 0° and 180°.

FIG. 4D illustrates the elevation radiation pattern 454 at ϕ=90° over angle θ between 0° and 180°. FIG. 4E illustrates the azimuth radiation pattern 452 at θ=90° over angle ϕ between 0° and 180°. As can be seen, the ridged slot array has a uniform azimuth radiation pattern 452, exhibiting less than 1 dB variation compared to 4 dB to the azimuth radiation pattern 252 of the conventional slot array.

In a further embodiment of the ridged waveguide slot array 400 shown in FIGS. 4A-4E and described in the paragraphs corresponding thereto, the longitudinal slots 422/424 (slots located at the same longitudinal position and formed on the front/back surface) may be formed on the narrowed waveguide section 416 in a log periodic arrangement to provide broadband coverage. In such an arrangement, successive longitudinal slots 422/424 have a slot opening (area of the opening), a slot offset distance±d from the center line 412, and a slot-to-slot separation distance (as described below) which successively decreases for successive longitudinal slots 422/424 moving away from end cap 430. In the opposite direction, successive longitudinal slots 422/424 are characterized by a slot opening area, an offset slot distance d and a slot-to-slot separation distance which successively increase moving towards the end cap 430. Exemplary, the slot opening, i.e., the area of the slot's opening, is characterized by a width and length dimension. The area of the slot openings is made larger/smaller, by increasing/decreasing the length of the slot opening, the width of the slot opening, or both the length and the width of the slot opening. Further exemplary, the area of slot openings, the offset dimension d of the slot openings, and the slot-to-slot separation distance are each larger for the slots 422/424 most proximate to the end cap, said dimensions being smaller for slots 422/424 most distal from the end cap 420. In a particular embodiment, the end cap 430 provides a short circuit for the array at a position substantially 0.5λ of the longest wavelength away (along the longitudinal center line) from the center of the most proximate slot 422/424.

Further exemplary, the side proximate to the slots 422/424 having the smallest opening is the side into which a signal is injected for transmission. If the supplied signal is of a frequency lower than intended for transmission by the first occurring slots 422/424 (i.e., if the slot is too small to radiate the supplied signal), then the slots do not significantly radiate the signal, and the supplied signal passes onto the subsequent (larger) slot. This process repeats until the supplied signal encounters the slots 422/424 which are sized to transmit the supplied signal. If a remaining portion of the supplied signal leaks to a subsequent slot (which would be too large for signal transmission, i.e., >0.5λ), that slot operates to reflect the signal portion back towards the appropriately-sized slots for transmission. Accordingly, the array 400 of the present invention provides improved transmission and reception efficiency over a broadband, the bandwidth being limited only by the cutoff frequency of the array 400.

Figure 5A:
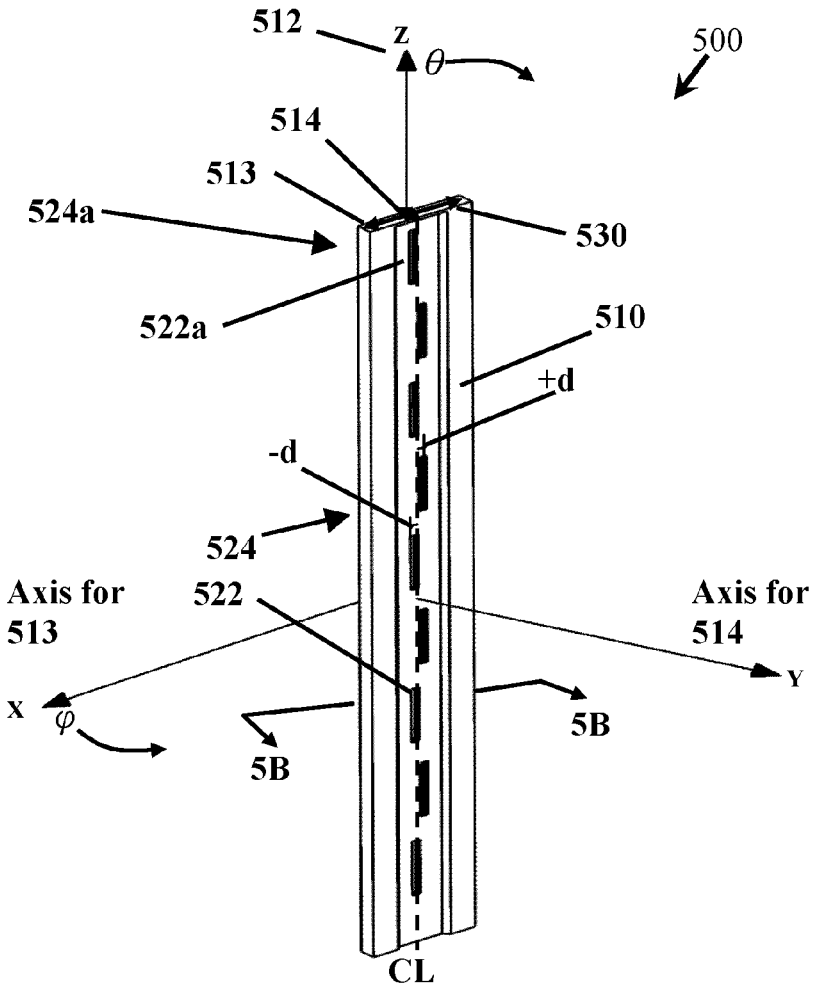
FIG. 5A illustrates a perspective view of a horizontally-polarized ridged waveguide slot array in accordance with one embodiment of the present invention.

FIG. 5A illustrates a perspective view of a horizontally-polarized ridged waveguide slot array 500 in accordance with one embodiment of the present invention. The array 500 includes a waveguide slot body 510 having longitudinal slots 522 and 524 disposed thereon. The waveguide slot body 510 is oriented along a longitudinal axis (exemplary shown as the z-axis) 512 which is the direction of propagation of a signal injected therein.

Transverse to the longitudinal axis 512, the waveguide slot body 510 defines a waveguide aperture (further detailed below) having a major dimension 513 (shown along the x-axis) and a minor dimension 514 (shown along the y-axis). The major dimension 513 defines the lowest frequency of operation for the array 500, and in one embodiment, is less than 0.5λ in its dimension. The waveguide slot body 510 includes longitudinal slots 522 and 524 disposed on respective opposing broadsides of the waveguide body 510. Each slot 522 is offset a predefined distance "d" from a center line "CL" or "C/L" of the waveguide slot body 510, whereby adjacent slots on this broadside wall are offset in opposing directions from the center line CL. Longitudinal slots 524 are disposed on the opposing broadside wall of the waveguide slot body 510 and represent a continuation of longitudinal slots 522 bored through the hollow waveguide slot body 510 into the second/opposing broadside wall. As such, opposing longitudinal slots 524 are disposed at substantially the same coordinates along the second/opposing broadside wall as slots 522 are disposed along the first broadside wall. An end cap 530 is located at the top of the array 500 (distal from the signal input of the array at the bottom end of the array). The first longitudinal slots (top most, and starting most proximate to end cap 530) on each broadside of the waveguide slot body 510 are identified with reference indicia 522*a* and 524*b*.

Figure 5B:
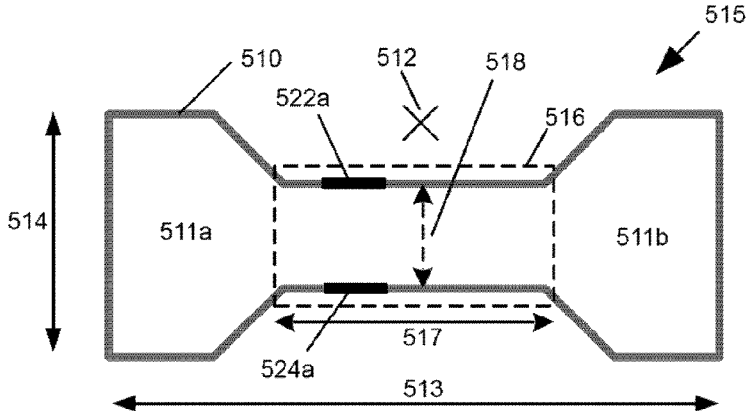
FIG. 5B illustrates an exemplary waveguide aperture for the ridged waveguide slot array shown in FIG. 5A.

FIG. 5B illustrates an exemplary waveguide aperture 515 for the ridged waveguide slot array 500 shown in FIG. 5A. The longitudinal slots 522 and 524 (only opposing slots 522*a* and 524*a* are shown to avoid obscuring the drawing) are disposed on opposing broadside walls of the waveguide body 510. The waveguide slot body 510 which includes a narrowed waveguide section 516 with forms a ridge waveguide section 516 in accordance with this embodiment of the invention. The narrowed/ridge waveguide section 516 extends longitudinally along the center line and has broadside walls on which the slots 522 and 524 are disposed. The cross-section of the ridge waveguide section 516, as shown in FIG. 5B includes a major dimension 517 and a minor dimension 518. The waveguide slot body 510 further includes two tapered waveguide sections 511*a* and 511*b* which are laterally opposed along the major dimension axis 513 of the waveguide aperture 515, with the narrowed/ridge waveguide section 516 disposed therebetween. Exemplary, the major dimension 517 of the narrowed waveguide section 516 is less than 0.5λ (one half wavelength of the center frequency of operation). Exemplary dimensions of the waveguide are shown in FIG. 5D, below.

As shown in FIG. 5B, longitudinal slots 522 and 524 (only slots 522*a* and 524*a* are depicted to avoid obscuring the drawing) are disposed (e.g., cut) in the ridge waveguide section 516 on respective broadsides thereof. In the illustrated embodiment, a plurality of longitudinal slots 522 are provided such that each is offset a predefined distance d from a center line CL along the longitudinal axis 512 of the ridged waveguide body 510, adjacent longitudinal slots being offset in opposing directions from the center line. The offsetting distance can be selected based upon the desired operating frequency. Opposing longitudinal slots 524 are disposed on the opposing broadside wall within the narrowed waveguide section 516 of the waveguide body 510 at substantially the same coordinates (e.g., within 10%) opposite the longitudinal slots 522.

Figure 5C:
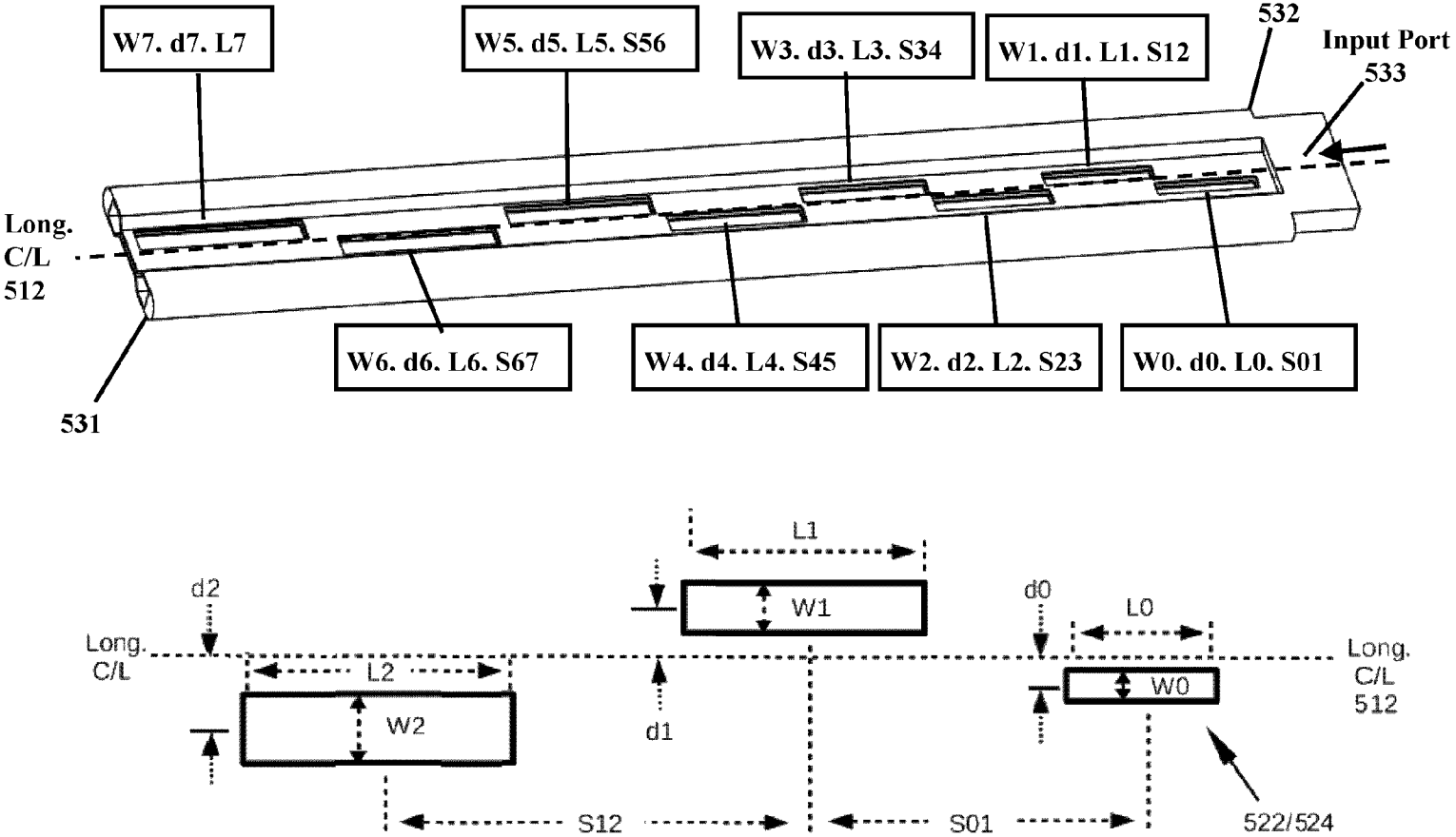
FIG. 5C illustrates perspective and conceptual views of the ridged waveguide slot array shown in FIGS. 5A and 5B.

FIG. 5C illustrates perspective and conceptual views of the horizontally-polarized ridged waveguide slot array 500 in accordance with the present invention. Exemplary of this embodiment, the longitudinal slots 522/524 are formed on the ridge waveguide section 516 in a log periodic arrangement to provide broadband coverage. In such an arrangement, starting from a first end 531 (which, e.g., would be the location of an end cap) and moving left to right toward a second end 532, successive slots 522/524 have a slot opening (area of the opening defined by width W and length L), an offset slot distance±d from the center line 512, and a slot-to-slot separation distance (Si,i+1) which successively decreases moving toward a second end 532 of the array 500. In the opposite direction moving right to left across the array 500 from the second end 532 to the first end 531, successive slots 522/524 are characterized by a slot opening, a slot offset distance, and a slot-to-slot separation distance which successively increases. Exemplary, the slot opening, i.e., the area of the slot's opening, is characterized by a width and length dimension W and L, respectively. The area of the slot openings is made smaller, by decreasing the length of the slot opening, the width of the slot opening, or both the length and the width of the slot opening. Further exemplary, the end 532 proximate to the slots 522/524 having the smallest opening is the side/end of the array into which a signal is supplied for transmission, the input signal provided via an input port 533 (which can be, e.g., a coaxial feed, or other signal input means). If the supplied signal is of a frequency lower than intended for transmission by the first occurring slots 522/524 (i.e., if the slot is too small to radiate the supplied signal), the slots do not radiate the signal, and the supplied signal passes onto the subsequent slot. This process repeats until the supplied signal encounters the slots 522/524 which are sized to transmit the supplied signal. If a remaining portion of the supplied signal leaks to a subsequent slot (which would be too large for signal transmission, i.e., >0.5λ), the slot operates to reflect the signal portion back towards the appropriately-sized slots 522/524 for transmission. Accordingly, the array 500 of the present invention provides improved transmission and reception efficiency over a broadband, the bandwidth being limited only by the cutoff frequency of the array 500. Further exemplary, an end cap (not shown) is located at the first end 531 of the array 500, whereby the end cap provides a short circuit for the array at a position substantially 0.5λ of the longest wavelength away (along the longitudinal center line) from the center of the most proximate slot 522/524.

Figures 5D, 5E:
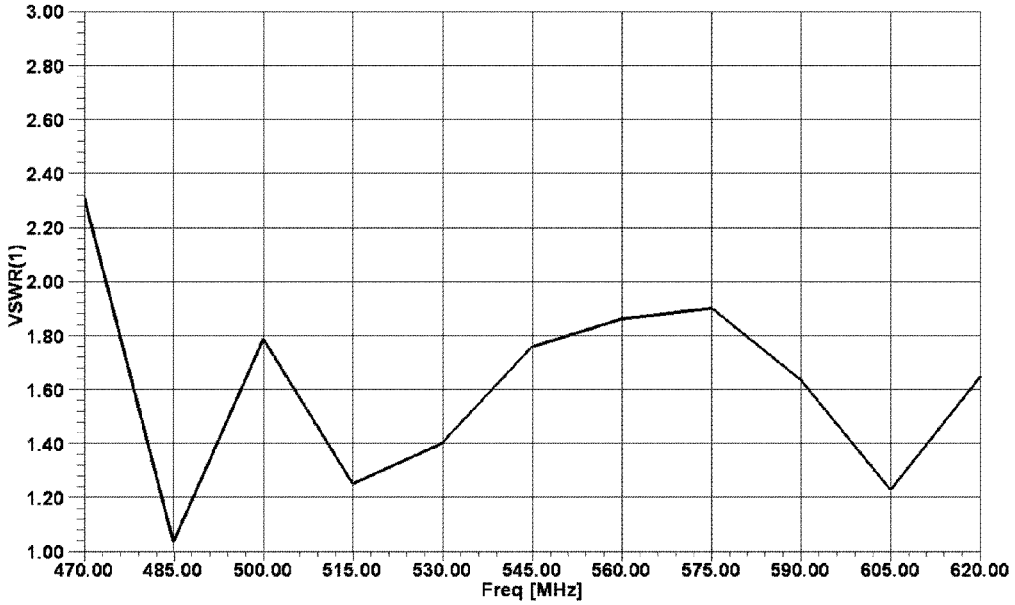
FIG. 5D illustrates a table showing exemplary slot opening and offset dimensions for the ridged wave slot array of FIGS. 5A-5C operating over the frequency band of 470 MHz to 620 MHz.
FIG. 5E illustrates the VSWR of the ridged waveguide slot array of FIGS. 5A-5C over the operating bandwidth of 470 MHz-620 MHz.

FIG. 5D illustrates a table showing exemplary slot opening and offset dimensions for array 500 having eight slots 522/524 operating over the frequency band of 470 MHz to 620 MHz. The waveguide body 510 has dimensions 225 mm×50 mm, and the ridge waveguide section 516 has dimensions 120 mm×20 mm. The cutoff frequency of the array 500 is 318 MHz.

Figure 5F:
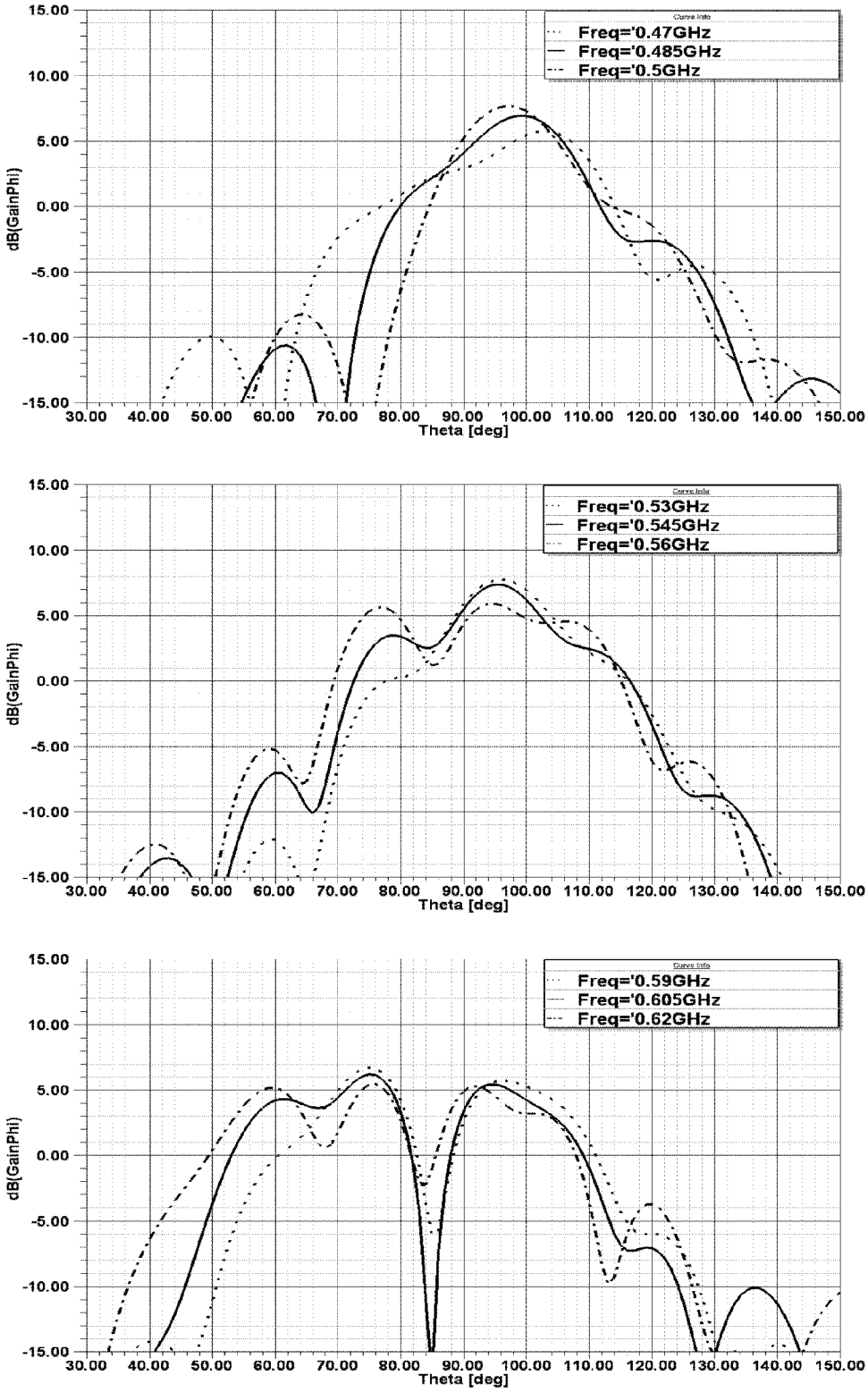
FIG. 5F illustrates the elevation radiation pattern of the ridged waveguide slot array of FIGS. 5A-5C.
Figure 5G:
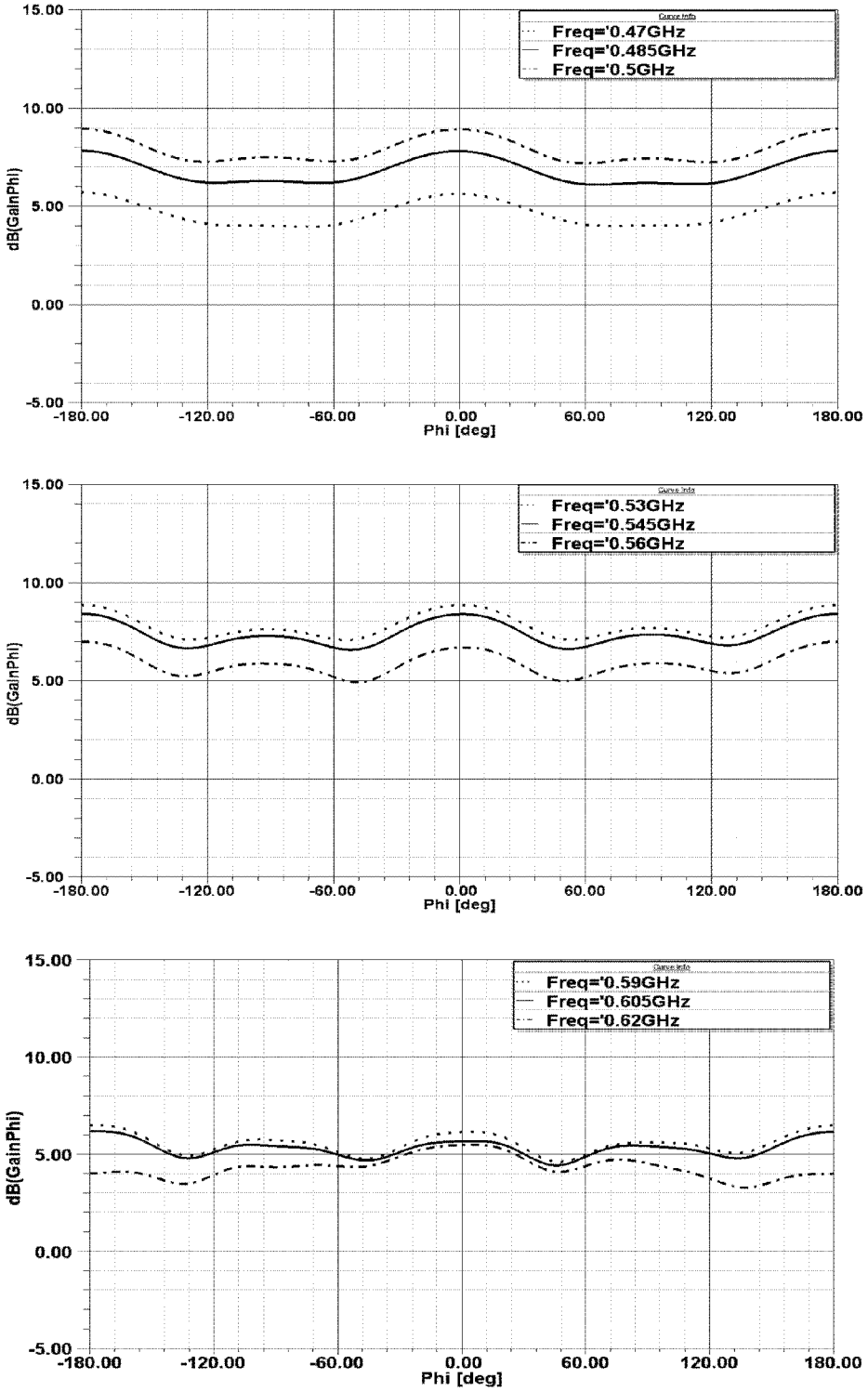
FIG. 5G illustrates the azimuth radiation pattern of the ridged waveguide slot array of FIGS. 5A-5C with a down tilt orientation of 5 degrees.

FIG. 5E illustrates the VSWR of the eight slot array 500 over the operating bandwidth of 470 MHz-620 MHz. FIG. 5F illustrates the elevation radiation pattern of the eight slot array 500 at frequencies of 470 MHz, 480 MHz, 500 MHz. 530 MHz, 605 MHz, and 620 MHz. FIG. 5G illustrates the azimuth radiation pattern of the ridged waveguide slot array 500 with a down tilt orientation of 5 degrees at the aforementioned frequencies. As can be taken from the illustrated data, the VSWR of the array 500 is 2:1 over the 470-620 MHz band, with a gain of between 5-8 dB.

In exemplary applications, the ridged waveguide slot array antennae 400 and 500 are used in television broadcasting stations or repeater stations. Further exemplary, the arrays are implemented to transmit signals within the UHF frequency band. In a specific embodiment, two array are used to cover the UHF band, a first array to cover the 470-620 MHz band, and a second array to cover the 620-870 MHz band. Those skilled in the art will appreciate that the invention can be implemented with other applications at the aforementioned or other operating frequencies as well.

In accordance with the exemplary embodiment of FIGS. 4A-4E, a ridged waveguide slot array 400 includes a waveguide slot body 410 and first and second ridged waveguide sections $\mathbf{418}_1$ and $\mathbf{418}_2$ attached to the waveguide slot body. The waveguide slot body 310 includes one or more walls that define a longitudinal axis 412 of the waveguide slot body, the waveguide slot body includes a plurality of slots 422/424 disposed on the one or more walls, the slots 422/424 extending along the longitudinal axis 412. The waveguide slot body defines a waveguide aperture 415 having a major dimension and a minor dimension, whereby the major dimension of the waveguide aperture is less than one-half wavelength of a signal intended for propagation therein. Additionally, each of the ridged waveguide sections $\mathbf{418}_1$ and $\mathbf{418}_2$ includes two spaced-apart opposing ridges 418*a*, and 418*b* disposed on the one or more walls of the waveguide slot body and extending along the longitudinal axis of the waveguide slot body, whereby the first and second ridged waveguide sections extending longitudinally along opposing lateral sides of the waveguide slot antenna body.

Further exemplary of the FIG. 4 embodiment, the waveguide slot body is characterized by a longitudinal center line 412, and the plurality of slots 422/424 are disposed on the waveguide slot body 410. Each slot of the plurality of slots is characterized by a slot area L×W, a slot offset distance di extending from center of the slot to the longitudinal center line 412, and a slot-to-slot separation distance Si,i+1 extending from center of the slot to center of an adjacent slot. Further, each of the slot area, the slot offset distance and the slot-to-slot separation distance is decreased successively for a succession of the plurality of slots. That is, the slots have a slot area, a slot offset distance, and a slot-to-slot separation distance which successively decreases as the slots extend along the longitudinal axis.

Further exemplary of the FIG. 4 embodiment, the slot area includes a slot width W and a slot length L, and each of the slot length, the slot width, the slot offset and the slot-to-slot separation distance is decreased successively for a succession of the plurality of slots.

Further exemplary of the FIG. 4 embodiment, the ridged waveguide slot array includes a first end of the ridged waveguide slot array, and a second end coupled to receive a transmission signal. A slot having each of the smallest slot area, the slot offset and the slot-to-slot separation distance is located proximate to the second end, and a slot having the largest slot area, the slot offset and the slot-to-slot separation distance is located proximate to the first end.

In accordance with the exemplary embodiment of FIGS. 5A-5G, a ridged waveguide slot array 500 includes a waveguide slot body 510 having one or more walls that define a longitudinal axis 512 of the waveguide slot body. The waveguide slot body includes a narrowed waveguide section 516 having a plurality of slots 522/524 disposed thereon. The waveguide slot body 510 is characterized by a longitudinal center line 512, and further defines a waveguide aperture 515 having a major dimension 513 and a minor dimension 514, wherein the major dimension of the waveguide aperture is less than one-half wavelength of a signal intended for propagation therein. Each slot 522/524 is characterized by a slot area, a slot offset distance di which extends from center of the slot to the longitudinal center line 512, and a slot-to-slot separation distance Si,i+1 extending from center of the slot to center of an adjacent slot. Each of the slot area, the slot offset and the slot-to-slot separation distance is decreased successively for a succession of the plurality of slots. That is, the slots have a slot area, a slot offset distance, and a slot-to-slot separation distance which successively decreases as the slots extend along the longitudinal axis.

Further exemplary of the FIG. 5 embodiment, the slot area includes a slot width W and a slot length L, and each of the slot length, the slot width, the slot offset and the slot-to-slot separation distance is decreased successively for a succession of the plurality of slots.

Further exemplary of the FIG. 5 embodiment, adjacent slots are offset in opposing directions from the longitudinal center line.

Further exemplary of the FIG. 5 embodiment, the ridged waveguide slot array 500 includes a first end 531 of the ridged waveguide slot array, and a second end (532) coupled to receive a transmission signal. A slot having each of the smallest slot area, the slot offset and the slot-to-slot separation distance is located proximate to the second end, and a slot having the largest slot area, the slot offset and the slot-to-slot separation distance is located proximate to the first end.

The ridged waveguide slot array 300, 400 and 500 may be manufactured using a variety of materials and processes. Materials such Kovar, brass, aluminium, and other materials used for the construction of waveguides may be employed. Further, different manufacturing techniques can be used to produce the arrays 300, 400 and 500, for example numerically-controlled machining, casting or other waveguide construction techniques.

As readily appreciated by those skilled in the art, the described processes and operations may be implemented in hardware, software, firmware or a combination of these implementations as appropriate. In addition, some or all of the described processes and operations may be implemented as computer readable instruction code resident on a non-transitory computer readable medium, the instruction code operable to control a computer of other such programmable device to carry out the intended functions. The computer readable medium on which the instruction code resides may take various forms, for example, a removable disk, volatile or non-volatile memory, etc.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serves to refer to one exemplary embodiment of a claimed feature, and the claimed feature is not limited to the particular embodiment referred to by the reference indicia. The scope of the claimed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A ridged waveguide slot array, comprising:

a waveguide slot body having one or more walls that define a longitudinal axis of the waveguide slot body, the waveguide slot body comprising a plurality of slots disposed on the one or more walls and extending along the longitudinal axis, the waveguide slot body defining a waveguide aperture having a major dimension and a minor dimension, wherein the major dimension of the waveguide aperture is less than one-half wavelength of a signal intended for propagation therein; and first and second ridged waveguide sections attached to the waveguide slot body, each of the ridged waveguide sections comprising two spaced-apart opposing ridges disposed on the one or more walls of the waveguide slot body and extending along the longitudinal axis of the waveguide slot body, the first and second ridged waveguide sections extending longitudinally along opposing lateral sides of the waveguide slot antenna body, wherein the waveguide slot body is characterized by a longitudinal center line, wherein each slot of the plurality of slots is characterized by a slot area, a slot offset distance extending from center of the slot to the longitudinal center line, and a slot-to-slot separation distance extending from center of the slot to center of an adjacent slot; and wherein each of the slot area, the slot offset distance and the slot-to-slot separation distance is decreased successively for a succession of the plurality of slots.

2. The ridged waveguide slot array of claim 1, wherein the slot area includes a slot width and a slot length, and wherein each of the slot length, the slot width, the slot offset and the slot-to-slot separation distance is decreased successively for a succession of the plurality of slots.

3. The ridged waveguide slot array of claim 1, wherein the waveguide slot body comprises two tapered waveguide sections laterally opposed along an axis of the major dimension of the waveguide aperture and a narrowed waveguide section disposed between the two tapered waveguide sections, wherein the major dimension of the waveguide aperture comprises a major dimension of the narrowed waveguide section, said major dimension of the narrowed waveguide section being smaller than one half wavelength of a signal intended for propagation therein.

4. The ridged waveguide slot array of claim 1, wherein adjacent slots are offset in opposing directions from the longitudinal center line.

5. The ridged waveguide slot array of claim 1, wherein the ridged waveguide slot array includes a first end of the ridged waveguide slot array, and a second end coupled to receive a transmission signal, wherein a slot having each of the smallest slot area, the slot offset and the slot-to-slot separation distance is located proximate to the second end, and a slot having the largest slot area, the slot offset and the slot-to-slot separation distance is located proximate to the first end.

6. The ridged waveguide slot array of claim 1, wherein the ridged waveguide slot array is included within a television transmitting station.

7. The ridged waveguide slot array of claim 6, wherein the ridged waveguide slot array is operable between 470 MHz-820 MHz.

8. The ridged waveguide slot array of claim 7, wherein a first ridged waveguide slot array is operable between 470 MHz-620 MHz, and a second ridged waveguide slot array is operable between 620 MHz-870 MHz.

9. A ridged waveguide slot array, comprising:

a waveguide slot body having one or more walls that define a longitudinal axis of the waveguide slot body, the waveguide slot body comprising a narrowed waveguide section having a plurality of slots disposed thereon and extending along the longitudinal axis, the waveguide slot body characterized by a longitudinal center line and defining a waveguide aperture having a major dimension and a minor dimension, wherein the major dimension of the waveguide aperture is less than one-half wavelength of a signal intended for propagation therein, wherein each slot of the plurality of slots is characterized by a slot area, a slot offset distance extending from center of the slot to the longitudinal center line, and a slot-to-slot separation distance extending from center of the slot to center of an adjacent slot; and wherein each of the slot area, the slot offset distance and the slot-to-slot separation distance is decreased successively for a succession of the plurality of slots.

10. The ridged waveguide slot array of claim 9, wherein the slot area includes a slot width and a slot length, and wherein each of the slot length, the slot width, the slot offset and the slot-to-slot separation distance is decreased successively for a succession of the plurality of slots.

11. The ridged waveguide slot array of claim 9, wherein adjacent slots are offset in opposing directions from the longitudinal center line.

12. The ridged waveguide slot array of claim 9, wherein the ridged waveguide slot array includes a first end of the ridged waveguide slot array, and a second end coupled to receive a transmission signal, wherein a slot having each of the smallest slot area, the slot offset and the slot-to-slot separation distance is located proximate to the second end, and a slot having the largest slot area, the slot offset and the slot-to-slot separation distance is located proximate to the first end.

13. The ridged waveguide slot array of claim 9, wherein the ridged waveguide slot array is included within a television transmitting station.

14. The ridged waveguide slot array of claim 13, wherein the ridged waveguide slot array is operable between 470 MHz-820 MHz.

15. The ridged waveguide slot array of claim 14, wherein a first ridged waveguide slot array is operable between 470 MHz-620 MHz, and a second ridged waveguide slot array is operable between 620 MHz-870 MHz.

* * * * *